US008991687B1

(12) United States Patent
Solomon

(10) Patent No.: US 8,991,687 B1
(45) Date of Patent: Mar. 31, 2015

(54) MAILBOX INDICATOR

(71) Applicant: Elias E. Solomon, Duxbury, MA (US)

(72) Inventor: Elias E. Solomon, Duxbury, MA (US)

( * ) Notice: Subject to any disclaimer, the term of this patent is extended or adjusted under 35 U.S.C. 154(b) by 0 days.

(21) Appl. No.: 14/050,703

(22) Filed: Oct. 10, 2013

(51) Int. Cl.
*A47G 29/14* (2006.01)
*A47G 29/122* (2006.01)

(52) U.S. Cl.
CPC ..... *A47G 29/1225* (2013.01)
USPC ..... 232/35

(58) Field of Classification Search
CPC ..... A47G 29/1205; A47G 29/1209; A47G 29/121; A47G 29/1225; A47G 2029/1225; E05F 1/10
USPC ..... 232/35, 34, 17, 45; 116/284; 49/386; 16/72
See application file for complete search history.

(56) References Cited

U.S. PATENT DOCUMENTS

| | | | | | |
|---|---|---|---|---|---|
| 522,045 | A | | 6/1894 | Chappell | |
| 597,420 | A | | 1/1898 | Kelly | |
| 706,843 | A | | 8/1902 | Moore | |
| 844,435 | A | * | 2/1907 | Wolf | 232/35 |
| 879,022 | A | * | 2/1908 | Wolf | 232/34 |
| 1,060,659 | A | * | 5/1913 | Ammann | 232/27 |
| 1,209,550 | A | | 12/1916 | Buckwalter | |
| 1,248,171 | A | * | 11/1917 | Schubert | 232/35 |
| 1,564,073 | A | | 12/1925 | Johnson | |
| 2,156,858 | A | | 5/1939 | Landis | |
| 2,431,838 | A | | 12/1947 | Staley | |
| 2,480,469 | A | * | 8/1949 | Horn | 232/35 |
| 2,849,176 | A | * | 8/1958 | McMinn | 232/35 |
| 3,030,058 | A | | 4/1962 | Rosing | |
| 3,106,335 | A | | 10/1963 | Allan | |
| 3,163,356 | A | | 12/1964 | Joehnk | |
| 3,331,552 | A | * | 7/1967 | Shultz | 232/35 |
| 3,498,256 | A | | 3/1970 | Hebal | |
| 3,586,235 | A | * | 6/1971 | Fishel | 232/45 |
| 3,589,329 | A | * | 6/1971 | Schuh | 232/35 |
| 3,880,344 | A | | 4/1975 | Earle | |
| 3,904,108 | A | * | 9/1975 | File | 232/35 |
| 3,958,752 | A | * | 5/1976 | Pieszchala | 232/35 |
| 3,968,928 | A | * | 7/1976 | Caldwell | 232/35 |
| 4,005,816 | A | * | 2/1977 | Malik | 232/35 |
| 4,026,461 | A | | 5/1977 | Hodge | |
| 4,073,430 | A | * | 2/1978 | Joris | 232/35 |
| 4,114,801 | A | | 9/1978 | Van Orden | |
| 4,205,778 | A | * | 6/1980 | File | 232/35 |
| 4,223,828 | A | | 9/1980 | Whitley et al. | |
| 4,299,058 | A | | 11/1981 | Spaulding | |
| 4,413,770 | A | | 11/1983 | Nye | |
| D278,469 | S | * | 4/1985 | Ross | D99/29 |
| 4,596,357 | A | * | 6/1986 | File | 232/35 |
| 4,660,757 | A | | 4/1987 | Hicks | |
| 4,720,042 | A | * | 1/1988 | Tapy | 232/35 |
| 4,723,702 | A | | 2/1988 | Martin | |
| 4,863,096 | A | | 9/1989 | Thomas | |
| 4,930,271 | A | | 6/1990 | Pizzichemi | |
| 4,986,467 | A | | 1/1991 | Bibbee | |
| 5,000,378 | A | * | 3/1991 | Dorr et al. | 232/17 |

(Continued)

*Primary Examiner* — William Miller
(74) *Attorney, Agent, or Firm* — David M. Driscoll, Esq.

(57) ABSTRACT

A mailbox indicator and lid closure system that includes a flag indicator mounted from a support plate of the container and connected by way of a cable to a bracket supported on the lid. Opening the lid causes the indicator to be pulled by the cable to the upright position thus indicating that mail has been delivered. A spring is connected between the container and lid to ensure that the lid remains open while mail is being delivered.

19 Claims, 4 Drawing Sheets

(56) References Cited

U.S. PATENT DOCUMENTS

| | | | | | |
|---|---|---|---|---|---|
| 5,004,148 | A | | 4/1991 | Windrem | |
| 5,031,828 | A | | 7/1991 | Fischer | |
| 5,178,320 | A | | 1/1993 | Bertone | |
| 5,226,589 | A | * | 7/1993 | Davis | 232/17 |
| 5,284,295 | A | * | 2/1994 | Steinfeldt | 232/35 |
| 5,596,841 | A | * | 1/1997 | Gentry et al. | 49/35 |
| 5,617,993 | A | | 4/1997 | Morris | |
| 5,833,132 | A | | 11/1998 | Bachmeier | |
| 6,299,061 | B1 | | 10/2001 | Henson | |
| 6,371,367 | B1 | * | 4/2002 | Otero | 232/35 |
| D478,702 | S | | 8/2003 | Dregney | |
| 7,007,839 | B1 | | 3/2006 | Piccolo | |
| 7,025,250 | B2 | * | 4/2006 | Wolfe, Jr. | 232/35 |
| 7,028,883 | B1 | | 4/2006 | Choi | |
| 7,905,390 | B1 | | 3/2011 | Settle et al. | |
| 2005/0274784 | A1 | * | 12/2005 | Mullins | 232/35 |

* cited by examiner

MAILBOX INDICATOR

FIELD OF THE INVENTION

The present invention relates to an improved method and device for indicating when mail has been delivered to a mailbox. The present invention also relates to an improved method and device for insuring that the lid is securely closed when delivery of the mail has been completed.

BACKGROUND OF THE INVENTION

There are many methods described for indicating when mail has been delivered to a mailbox ranging from very simple to complex means. As will be described later, all these inventions have drawbacks in that they do not meet all the requirements for an inexpensive, simple and reliable indicating means that also ensure the secure closure of the mailbox lid. A number of mailbox indicators rely on gravity for the indicator to rotate to the vertical position. This simple means has a drawback. Snow, ice and debris may prevent the deployment of the indicator to the vertical position. Some prior art devices rely on more complex and relatively expensive lever assemblies and are awkward to install. There are other spring closure mechanisms such as described in U.S. Pat. No. 5,226,589 to Davis. Examination of this shows the spring extending from within the body of the mailbox to the lid. The lid is held open when the spring bends past the hinge line. This has three disadvantages:

1. The spring is fastened between the inside back of the mailbox and the lid. This is awkward to do as an add-on to a mailbox.
2. The spring distorts around the hinge line when the lid is opened and there is the possibility of wear and snagging over a period of time.
3. The mail will lie on top of the spring when the lid is closed.

Other mail box indicator devices are complex. See for example, U.S. Pat. No. 3,163,356 to Joehnk which is a complex assembly that shows the lid connected to an external spring located at the bottom of the mailbox. However, the lid is held open when the internal box is pulled out of the mailbox and not by the force exerted by the spring. The function of the spring is to assist in closing the lid when the box is pushed back into the mailbox. The spring does not assist in keeping the lid open.

Another disadvantage is that the assembly can only be used on a mailbox mounted on a post. Most mailboxes mount on a platform attached to a post. Joehnk's invention would require clearance between the platform and the bottom of the mailbox in order for the spring to function.

Accordingly, it is an object of the present invention to provide an improved mailbox indicator and lid closure system. Another object of the present invention is to provide an activating system that pulls the indicator or flag to the vertical position while slicing through any obstructions such as snow, ice or debris. The cable arrangement of the present invention effectively forces its way past obstructions thus ensuring that the indicator is successfully deployed. In accordance with the present invention, the flexible cord exerts force when pulled but then relaxes when the force is removed.

Still another object of the present invention is to provide an improved mailbox indicator and lid closure system that can be provided in a simple kit that can be readily attached to the mailbox without the requirement of any tools.

BRIEF SUMMARY OF THE INVENTION

In accordance with the present invention, the device is in the form of an indicator located on a plate that attaches to the container of the mailbox and connects to the lid of the mailbox by a flexible cable. In addition, the lid attaches to the container of the mailbox by means of a spring. Opening the lid causes the indicator to be pulled by the cable to the upright position thus indicating that mail has been delivered. In addition, the design of the connection of the spring to the lid ensures that the lid remains open while mail is being delivered. Moving the lid upward past the horizontal position of the hinge causes the spring to pull the lid closed thus ensuring that the lid is not left open if the hinge is loose or if the lid is not properly closed by the mail carrier.

Another feature of the indicator system of the present invention is that the spring is attached externally to the mailbox and fastened between the side of the mailbox and the outside of the lid. This avoids interference with any means used to attach the mailbox—either to a post or on to a flat surface. The spring performs its normal extension function without distortion when the lid is opened. The mailbox with this attachment can be used in any type of installation.

The present invention is ideal for retrofitting mailboxes and provides both an indication of delivered mail and a closure of the lid. It includes a plate with an aggressive self-adhesive backing that attaches to the side of the mailbox and a bracket with an aggressive self-adhesive backing that attaches to the lid. The adhesive used is one of a family that has wide use in the aircraft and automobile industry. One end of the cable attaches to the indicator mounted on the plate and the other end to the bracket on the lid. The spring attaches between the plate and the bracket on the lid.

DESCRIPTION OF THE DRAWINGS

It should be understood that the drawings are provided for the purpose of illustration only and are not intended to define the limits of the disclosure. In the drawings depicting the present invention, all dimensions are representative and not to scale. The foregoing and other objects and advantages of the embodiments described herein will become apparent with reference to the following detailed description when taken in conjunction with the accompanying drawings in which:

FIG. 10 is a perspective view of the bracket; and

DETAILED DESCRIPTION

Figure 1:
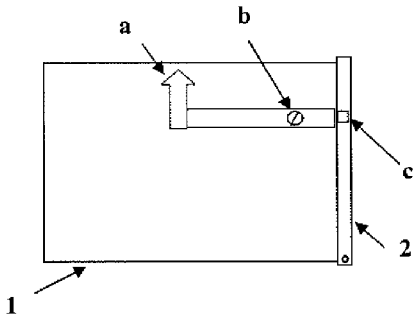
FIGS. 1 and 2 illustrate a conventional mechanism for a mailbox.
Figure 2:
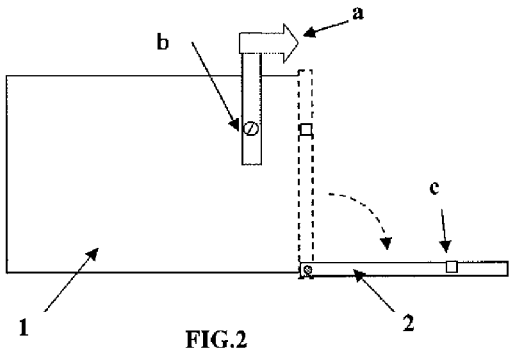

Reference is now made to the schematic diagrams of FIGS. 1 and 2. This describes a very simple device that is currently known. This prior art indicator device relies upon gravity to rotate the indicator a to the vertical position such as illustrated in FIG. 2. In FIG. 1 the lid is shown in its closed position. The indicator a is pivoted at pivot point b. The indicator a is preferably constructed of a ferromagnetic material and is balanced horizontally about the pivot location b. In FIG. 1 the indicator is held horizontal by means of a magnet c that is supported at the lid 2.

With regard to FIGS. 1 and 2, it is noted that FIG. 2 shows the lid in its open position. When the indicator flag a moves out of the magnetic range of the magnet c, the flag a is unbalanced and swings to an upright position.

There are three main disadvantages to this device.

1. The indicator can be prevented from moving due to an accumulation of snow, ice, or debris. There is no force other than gravity that is exerted on the indicator.

2. The indicator has to be fastened to the side of the mailbox by means of a screw.

3. The magnet has to be fastened somehow to the lid. The magnet has to be small and, if aggressive adhesive is used, still presents a problem as it would present a very small surface area for the adhesive.

For simplicity and in accordance with the present invention, the term "cable" is used to describe any flexible means such as cord, wire, chain, etc. The term "spring" is used to describe any elastic means such as a metal spring, plastic spring, elastic cord, etc.

Reference is now made to FIGS. 3-9 for further details of the mailbox indicator and lid closure system of the present invention. The assembly is comprised of preferably a few simple and inexpensive parts which are set forth in the exploded perspective view of FIG. 7. These parts include a small plate 4 that may be approximately four inches square and a flat indicator flag 5 that is pivotable from the plate 4. A bracket 3 is provided for securing to the lid. The components also include a cable 7, a spring 10 and miscellaneous screws or fasteners the function of which are described hereinafter.

Figure 8:
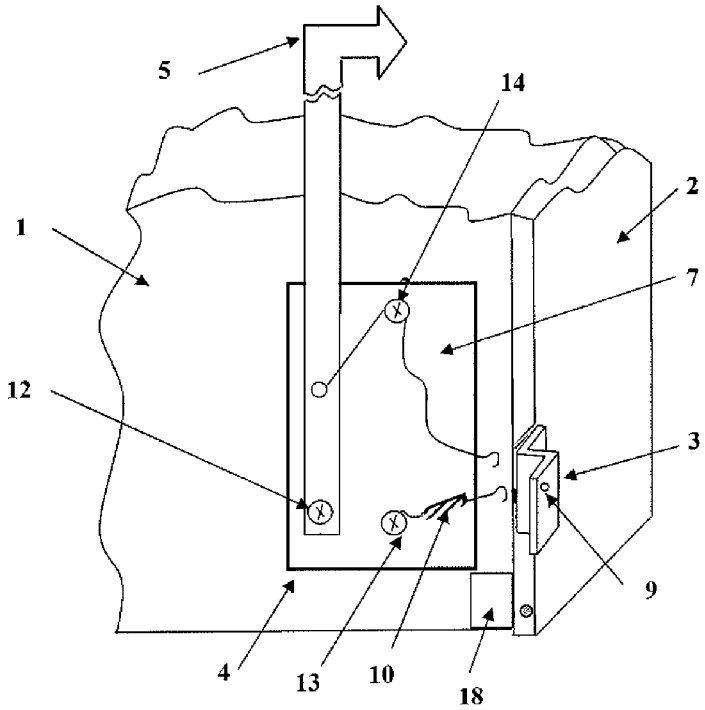
FIG. 8 is a fragmentary detailed view showing connections between the plate and bracket.

FIG. 8 is a perspective view of a section of the mailbox with the various parts assembled on to the container 1 and the container lid 2. These various components may be factory assembled on to the respective plate 4 and bracket 3. Loose ends of the cable and spring are basically the only attachments required between the plate and bracket. This system may be supplied as a kit that can be readily attached to the mailbox without the need for any tools. In this regard, an aggressive adhesive backing is used on the bracket 3 and the plate 4 to hold them securely to the respective container lid and container. The installation is anticipated as being relatively simple. A location guide 18 (see FIG. 9) may be provided in the form of a removable piece of material that is first attached to the corner of the mailbox. The plate 4 (factory assembled with the spring and cable attached) and bracket 3 are then aligned as shown and pressed firmly into place. FIG. 8 shows the plate 4 and bracket 3 in place. On the other hand, FIG. 9 illustrates these components as exploded away from the container and lid.

Figure 7:
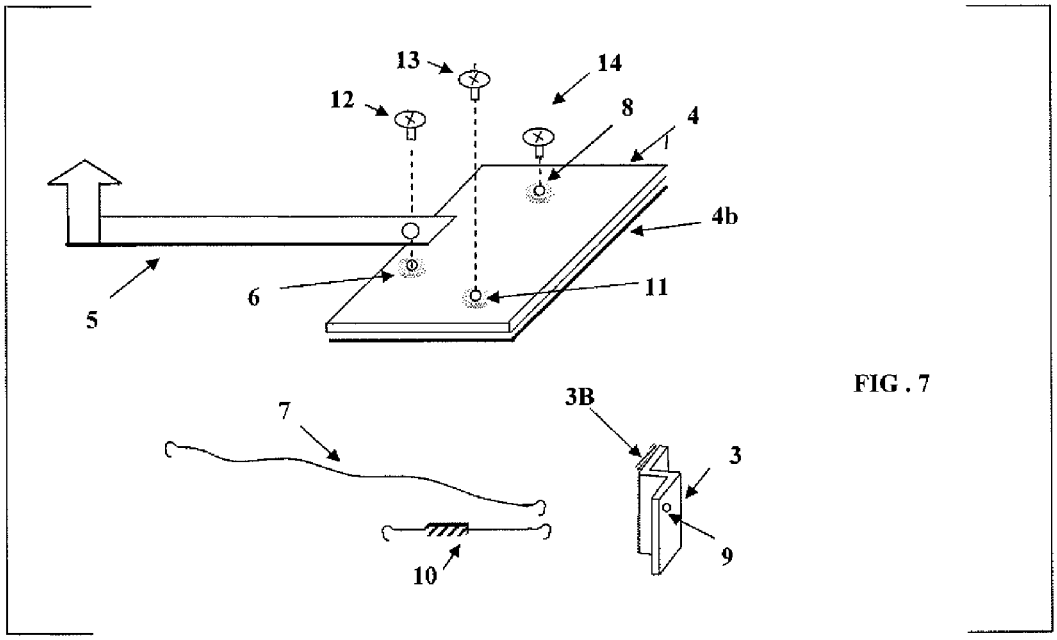
FIG. 7 is a fragmentary perspective view showing the main components that may comprise a kit used for retrofitting an existing mailbox.

As indicated previously, the main components of the system of the present invention are illustrated in FIG. 7 including the main support plate 4. As indicated previously, this may be of a dimension of four inches square. The bracket 3 is smaller than the plate 4 and thus may be of a rectangular shape of two inches by one inch. Both the plate 4 and the bracket 3 are attached by an aggressive adhesive material to the respective container 1 and lid 2.

A bottom pivot of the flag 5 is secured by one of a series of fasteners. For this purpose, the plate 4 is provided with three press-inserted pem-nuts 6, 8 and 11 that are each adapted to receive a corresponding screw member 12, 14 and 13. The screw member 12 provides a pivot for the bottom end of the flag 5. This is illustrated by the screw 12 in FIGS. 5, 6, 7 and 8. In FIG. 8 spaced above the screw 12 is a hole in the flag that receives one end of the cable 7. The pem-nut 8 receives a screw 14 that functions as a guide for the cable 7. See FIGS. 8 and 9 wherein the cable 7 is attached at the hole in the flag, passes over the guide screw 14 and is secured at the opposite end to a tie point 9 of the bracket 3.

Figures 9, 11:
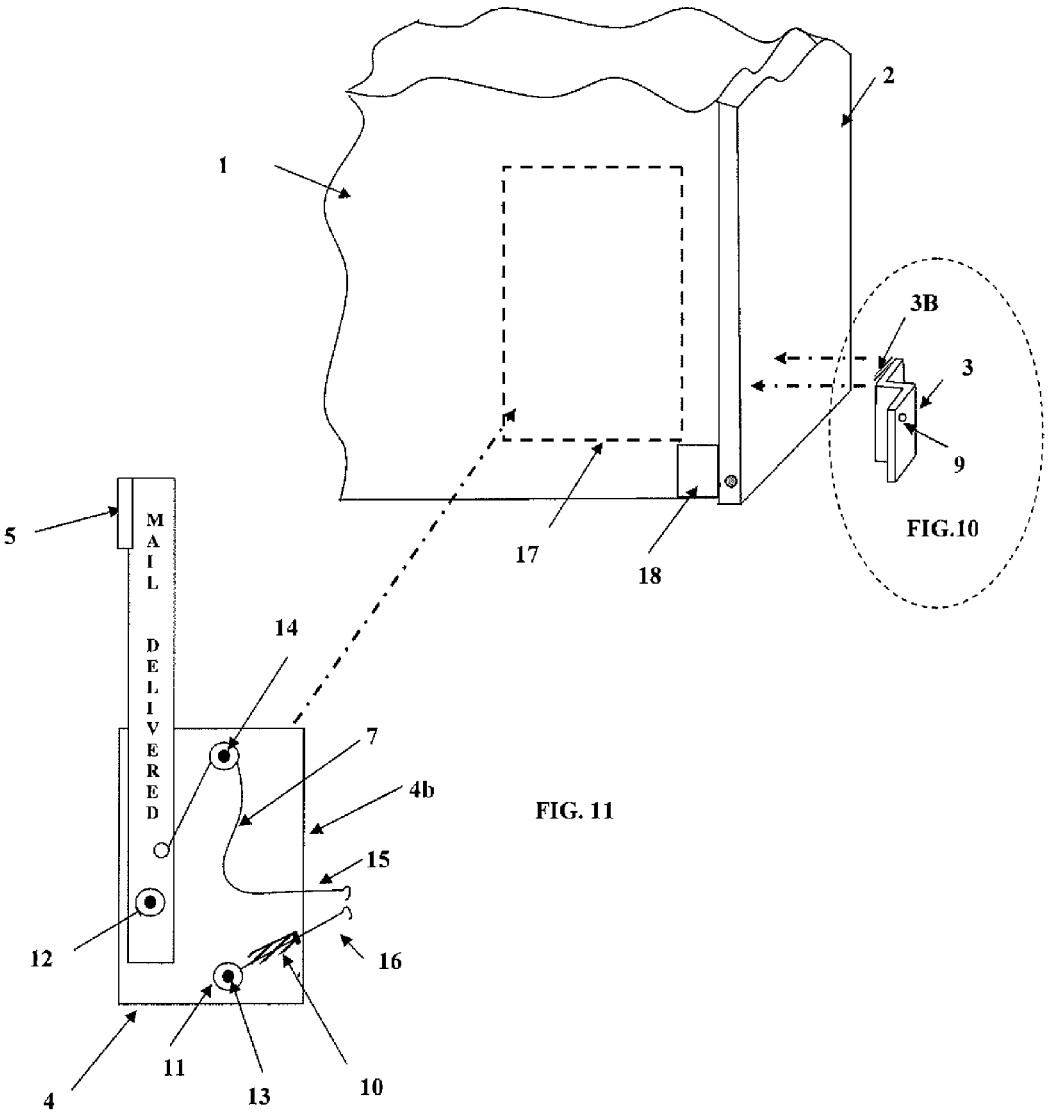
FIG. 9 is a further fragmentary perspective view showing components exploded away from the mailbox container.
FIG. 11 is a side elevational view of the plate.

Regarding the spring 10, reference may also be made to FIGS. 7-9. The spring 10 has one end fixed at the screw 13. The other end of the spring 10 attaches to the tie point 9 of bracket 3.

Figure 5:
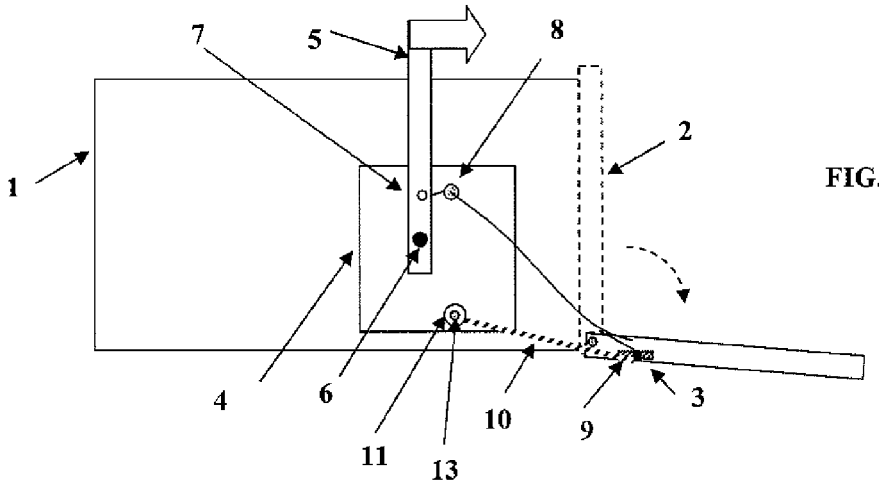
FIG. 5 is a side elevation view similar to that shown in FIG. 3 but with the lid open.
Figure 6:
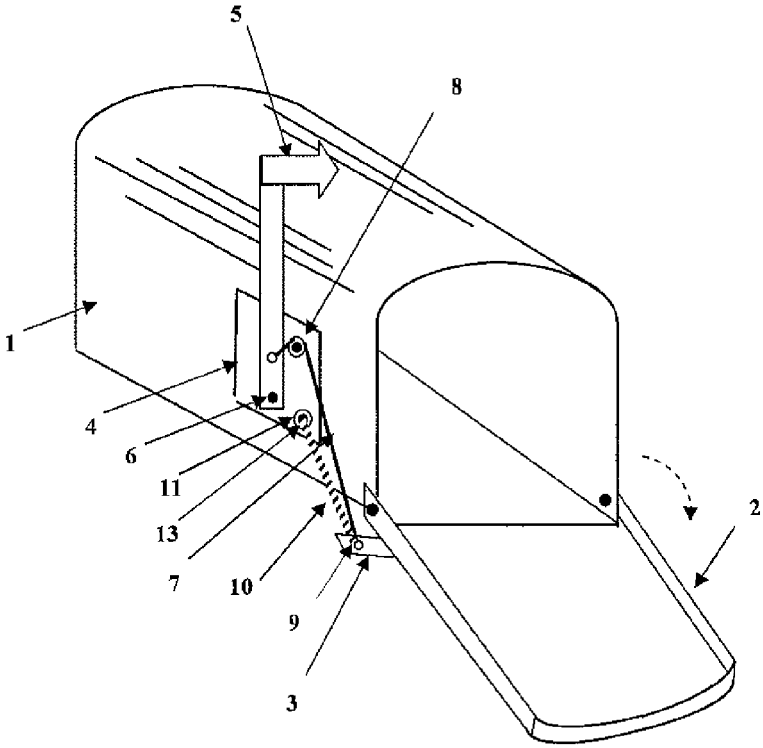
FIG. 6 is a perspective view similar to that shown in FIG. 4 with the lid open.

For the assembly of the kit of the present invention, with the indicator flag 5 in the upright position, the cable 7 is in a slacked position. The installation is completed by hooking the end 15 of the cable 7 in the end 16 of the spring 10 to the tie point 9 at the bracket 3. Refer to FIG. 8 that shows the connections of the cable 7 and the spring 10. FIGS. 5 and 6 show the components assembled on the container with the lid in the open position. The indicator flag 5 can then be moved to the horizontal position. This action tensions the cable, such as depicted in FIG. 4.

The indicator flag 5, plate 4 and bracket 3 can be constructed inexpensively. For example, these components can be produced by means of a stamping process. Metal or plastic can be used for these components. The press-inserted pem-nuts 6, 8 and 11 are meant to be press-fitted into the plate 4 and are each for receiving a corresponding screw 12, 13, 14. The cable 7 can be a wire, cord, chain or other strong flexible means with hooks at either end with the cable arranged to engage over the guide 14. The guide 14 may be somewhat more enlarged than that illustrated in the drawings and the cable 7 extends over the guide 8 enabling the cable to ride over and extend relative to the fixed guide. The cable 7 interconnects the hole in the flag, by way of the guide 14 to the tie point 9 at the bracket 3. The tie point 9 may be any type of a fastener device that can hold the hooked end of either the cable 7 or the spring line 10. Thus, the spring assembly 10 is basically comprised of a spring that has a hook at each end of the spring assembly. One end of this engages the screw 13 to hold that end of the spring in place. The other end is hooked into the tie point 9 at the bracket 3.

To summarize, the plate 4, as well as the bracket 3 are held to the respective container and lid by providing an aggressive self-adhesive backing. This is shown, for example, in FIG. 7 by the adhesive backing **3*b* of the bracket 3 and the adhesive backing 4*b* of the plate 4. The indicator flag 5 is an elongated member that may be provided with one edge bent so as to be visible from any direction. The pem-nuts 6, 8, 11 are a conventional device. A pem-nut is an internally threaded fastener that is adapted to receive a screw-type device. When this device is pressed into metal, it tends to displace the host material around a mounting hole causing it to cold flow into a specially designed annular recess in the shank of the fastener. Thus, a pem-nut becomes a permanent part of the plate structure. Each of these devices can receive a screw-type fastener. The flexible cable 7 is deployed around the fastener 14 at the pem-nut 8. With one end attached at the tie point 9 of the bracket 3 and the other looped through the hole in the flag indicator 5. The spring 10 attaches between the fastener 13 and the tie point 9 of the bracket 3**.

Figure 3:
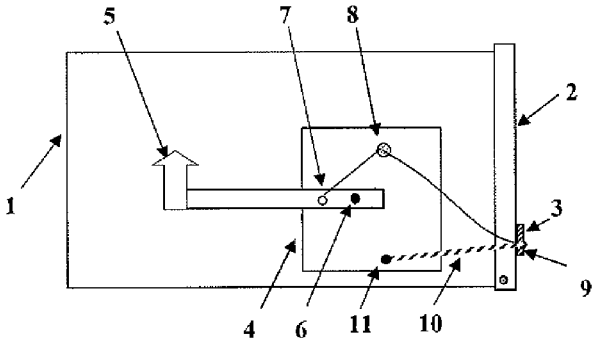
FIG. 3 is a schematic side elevation view of a first embodiment of the present invention.
Figure 4:
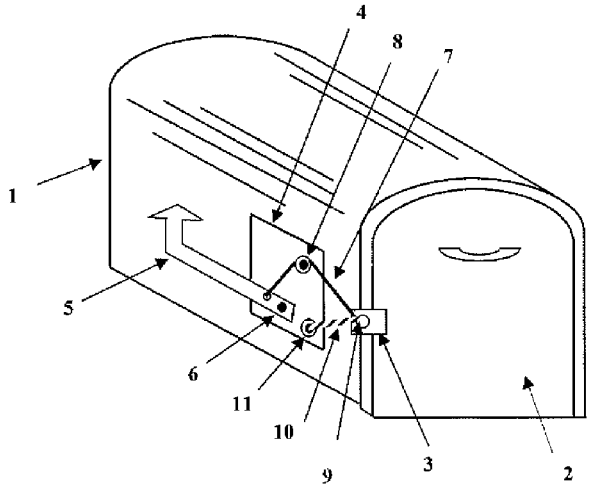
FIG. 4 is a perspective view of the embodiment of FIG. 3.

FIGS. 3 and 4 illustrate the mailbox 1 with the lid 2 closed. In this position, as particularly illustrated in the schematic side view of FIG. 3, the cable is held taut over the guide 8, 14. This guide assures that the direction of the force pulling the indicator is directed efficiently. In FIG. 3 it is noted that with the indicator in its stored position, there is a greater distance between the end of the cable and the guide than in the position illustrated in FIG. 5. In the position of FIGS. 3 and 4, the spring 10 is shown. The placement of the spring is such that it is sufficiently extended to hold the lid in this closed position.

Reference is now made to FIGS. 5 and 6 which illustrate the mailbox container 1 having the lid 2 in its opened position. Upon the opening of the lid, the cable 7 is pulled thus forcing the indicator 5 to rotate to the illustrated upright or vertical position. The cable 7 will slice through snow or other obstructions to ensure that the indicator flag 5 is fully deployed. The opening of the lid also further extends the spring 10. The assembly is constructed so that when the lid passes the horizontal position of the hinge, the lid 2 essentially toggles to an open position. The lid toggles open when it is moved passed the horizontal position and the resolution of forces pulls the lid downward and causes it to remain open while mail is being placed in the mailbox.

Thereafter, moving the lid 2 upwards past the horizontal position of the hinge changes the direction of the force exerted by the spring 10 causing the lid 2 to close firmly. Because the cable 7 is flexible to a certain extent, it slackens and does not exert any force on the indicator 5. Thus, the indicator flag 5 remains in this upright position.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A mailbox indicator system comprising an indicator flag that is constructed and arranged for attachment to a container of a mailbox, a cable that interconnects the indicator flag and container lid, a plate secured to an outer surface of the mailbox container, a bracket secured to the lid, a biasing member connected to said lid for biasing the lid to both open and closed positions, wherein said biasing member comprises a spring that is attached to the plate at one end and into a tie point at the bracket.

2. The mailbox indicator system of claim 1 including a fastener for rotatably securing the indicator flag to the plate.

3. The mailbox indicator system of claim 1 wherein the plate includes a self-adhesive backing to attach the plate to the mailbox container.

4. The mailbox indicator system of claim 1 wherein the bracket comprises a stepped bracket.

5. The mailbox indicator system of claim 1 including a self-adhesive backing for attaching the bracket to a front surface of the lid.

6. The mailbox indicator system of claim 1 wherein said indicator flag is constructed and arranged so that it is visible from multiple viewing angles.

7. The mailbox indicator system of claim 1 wherein the cable is arranged so that the force acting on the lid is directed in the direction of the cable when the lid is closed.

8. The mailbox indicator system of claim 7 wherein the force of the cable acting on the lid, when the lid is opened, maintains the lid in the open position.

9. The mailbox indicator system of claim 8 wherein the cable controls the lid to close when the lid is moved upward past a horizontal position of the lid.

10. The mailbox indicator system of claim 1 including a pivot for supporting the indicator flag from the plate, and wherein the spring is fastened to the plate at a location below the indicator flag pivot.

11. The mailbox indicator system of claim 1 including a fastener for rotatably securing the indicator flag to the plate, and wherein the bracket is secured to an outside surface of the lid.

12. A mailbox indicator system comprising an indicator flag that is constructed and arranged for attachment to a container of a mailbox, a cable that interconnects the indicator flag and container lid, a plate secured to an outer surface of the mailbox container, and a guide secured to the plate, said cable rides over the guide.

13. The mailbox indicator system of claim 12 wherein the guide is located at a position on the plate that is disposed above a pivot location of the indicator flag.

14. The mailbox indicator system of claim 12 further including a biasing member connected to said lid for biasing the lid to both open and closed positions and a bracket on the lid.

15. The mailbox indicator system of claim 14 wherein said biasing member comprises a spring that is attached to the plate at one end and into a tie point at the bracket.

16. A mailbox indicator system comprising an indicator flag that is constructed and arranged for attachment to a container of a mailbox, a cable that interconnects the indicator flag and container lid, a plate secured to an outer surface of the mailbox container, a bracket secured to the lid, and a biasing member connected to said lid for biasing the lid to both open and closed positions, wherein the biasing member comprises a spring that is attached to the plate at one end and into a tie point at the bracket wherein the cable is arranged so that the force acting on the lid is directed in the direction of the cable when the lid is closed, and the cable is connected between the indicator flag at a generally middle section thereof and the bracket that is secured to the lid.

17. The mailbox indicator system of claim 16 wherein the force of the cable acting on the lid, when the lid is opened, maintains the lid in the open position, and wherein the cable controls the lid to close when the lid is moved upward past a horizontal position of the lid.

18. The mailbox indicator system of claim 16 further including a guide secured to the plate, said cable rides over the guide.

19. The mailbox indicator system of claim 18 wherein the guide is located at a position on the plate that is disposed above a pivot location of the indicator flag.

* * * * *